US010596587B2

(12) United States Patent
Park

(10) Patent No.: US 10,596,587 B2
(45) Date of Patent: Mar. 24, 2020

(54) PRIMER DEVICE AND APPLICATION SYSTEM APPLYING THE DEVICE

(71) Applicants: Hyundai Motor Company, Seoul (KR); Kia Motors Corporation, Seoul (KR)

(72) Inventor: Byung Chan Park, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 225 days.

(21) Appl. No.: 15/705,796

(22) Filed: Sep. 15, 2017

(65) Prior Publication Data

US 2018/0015496 A1 Jan. 18, 2018

Related U.S. Application Data

(62) Division of application No. 14/922,130, filed on Oct. 24, 2015, now Pat. No. 9,795,980.

(30) Foreign Application Priority Data

May 29, 2015 (KR) ..... 10-2015-0076176

(51) Int. Cl.

| | |
|---|---|
| ***B05C 1/06*** | (2006.01) |
| ***B05C 1/08*** | (2006.01) |
| ***B05C 5/02*** | (2006.01) |

(52) U.S. Cl.

CPC ..... *B05C 1/06* (2013.01); *B05C 1/08* (2013.01); *B05C 5/02* (2013.01); *A46B 2200/20* (2013.01)

(58) Field of Classification Search

CPC ..... A46B 14/04; A46B 17/06; A46B 2200/20; B05C 1/06; B05C 1/08; B05C 5/02

USPC ..... 15/38

See application file for complete search history.

(56) References Cited

U.S. PATENT DOCUMENTS

| | | | | |
|---|---|---|---|---|
| 1,542,025 | A * | 6/1925 | Ballman | A46B 17/06 15/38 |
| 4,912,797 | A * | 4/1990 | Brackett | A46B 13/04 15/38 |
| 5,277,927 | A * | 1/1994 | Burns | B05B 12/082 427/8 |
| 6,402,846 | B1 | 6/2002 | Johnson | |
| 6,666,925 | B2 * | 12/2003 | Brackett | A46B 17/06 134/6 |
| 7,043,815 | B2 | 5/2006 | Lande et al. | |

(Continued)

FOREIGN PATENT DOCUMENTS

| | | |
|---|---|---|
| JP | 3112813 U | 8/2005 |
| JP | 2006-015177 A | 1/2006 |

(Continued)

*Primary Examiner* — Marc Carlson

(74) *Attorney, Agent, or Firm* — Mintz Levin Cohn Ferris Glovsky and Popeo, P.C.; Peter F. Corless

(57) ABSTRACT

An application system is provided and includes a primer device configured to apply a primer, a sealer unit configured to apply a sealer and a change tool selectively connected to the primer device and the sealer unit. The application system further includes a connecting portion that is coupled to the primer device and the sealer unit, respectively to be selectively connected to the change tool. Accordingly, maintenance and repair costs may be reduced, and the required installation space may be minimized.

2 Claims, 4 Drawing Sheets

(56) References Cited

U.S. PATENT DOCUMENTS

| | | | |
|---|---|---|---|
| 2006/0172081 | A1 | 8/2006 | Flinn et al. |
| 2009/0298129 | A1 | 12/2009 | Spence et al. |

FOREIGN PATENT DOCUMENTS

| | | | |
|---|---|---|---|
| KR | 10-2009-0111470 | A | 10/2009 |
| KR | 10-2011-0111660 | A | 10/2011 |

* cited by examiner

PRIMER DEVICE AND APPLICATION SYSTEM APPLYING THE DEVICE

CROSS-REFERENCE TO RELATED APPLICATION

This application is a Division of application Ser. No. 14/922,130 filed on Oct. 24, 2015 which claims priority to and the benefit of Korean Patent Application No. 10-2015-0076176 filed in the Korean Intellectual Property Office on May 29, 2015, the entire contents of which are incorporated herein by reference in their entirety.

BACKGROUND (a) Field of the Invention

The present invention relates to a primer device and an application system applying the device and more particularly, to an application system that automatically applies the device by using a change tool.

(b) Description of the Related Art

Generally, various types of glass are installed within a body of a vehicle, and the glass attaches to the vehicle body via a sealer. Prior to installation, a primer applied to the glass reinforces the adherence between the glass and the sealer. The primer device provided for applying the primer includes a dry air generator that eliminates moisture from external air and supplies the dry external air, a Methyl Ethyl Ketone (MEK) storage tank that supplies MEK gas due to the dry air, and a primer storage tank that supplies the primer to an applying gun which engages a primer brush by pressure of the MEK gas.

Further, the sealer device for applying the sealer includes a drum pump that pumps the sealer stored in a drum, a flow control valve that adjusts an amount of sealer exhausted from the drum pump, and a sealer gun that injects the sealer. Typically, the primer device includes equipment to supply the primer to the primer brush, and the sealer device includes additional equipment for supplying the sealer to the sealer gun.

However, when the primer device and the sealer device are respectively provided, then a total number of primer devices and sealer devices may be increased based on to the type of glass installed in the vehicle body. For example, an increase in the total number of devices thereby requires a larger area to install the devices. Moreover, maintenance and repair cost of each device are multiplied by the number of devices. In particular, two primer devices and two sealer devices are required for installing a front glass and a rear glass. Therefore, in this case, the maintenance and repair costs incurred are for a total four devices rather than for the cost of a single device.

The above information disclosed in this section is merely for enhancement of understanding of the background of the invention and therefore it may contain information that does not form the prior art that is already known in this country to a person of ordinary skill in the art.

SUMMARY

The present invention provides a primer device and an application system for applying the device performing primer and sealer functions. An exemplary embodiment provides an application system that may include a primer device that may be configured to apply a primer, and a sealer unit that may be configured to apply a sealer. The application system may further include a change tool selectively connected to the primer device and the sealer unit and a connecting portion provided to the primer device and the sealer unit respectively, to be selectively connected to the change tool.

In some exemplary embodiments, the primer device may include a robot arm that may be connected to the primer device or the sealer unit to actuate (e.g., move) the primer device or the sealer unit to an application position. In other exemplary embodiments, the change tool may include an adapter connected (e.g., combined or integrated into) to the robot arm and a docking interface that may be mounted proximate to the adapter and may be coupled to the connecting portion.

The primer device may include a primer housing that may be configured to store the primer, and a primer inlet that may be configured to inject the primer. The primer device may further include a pressure control valve to adjust pressure of the primer housing, a nozzle portion that may be configured to supply the primer disposed within the primer housing into a brush and a flow control valve which may be disposed at the nozzle portion to adjust an amount of the exhausted primer. The brush may be configured to apply the primer supplied from the nozzle portion.

The application system may include a plate coupled to (e.g., combined) to the docking interface, a belt box disposed at a lower portion of the plate and a motor that may be configured to provide torque. Further, a belt may be disposed within the belt box and may be configured to receive the torque from the motor. An impeller may be disposed within (e.g., internal to) the primer housing and may be configured to rotate by receiving torque from the belt to prevent the primer from hardening. A plate aperture may be formed on the plate or the belt box to allow visibility therein.

In some exemplary embodiments, the application system may further include an elastic portion that may be disposed between the nozzle portion and the brush. Furthermore, one side of the elastic portion may be fixed to the nozzle portion to decrease vibration generated at the brush. The elastic portion may include at least one elastic member, an upper plate that may be mounted and fixed to the upper portion of the elastic member and a lower plate that may be configured to support the elastic member at the lower side of the elastic member. In other exemplary embodiments, the elastic portion may include at least one elastic member; an upper plate that may be mounted and fixed to the upper portion of the elastic member; and a lower plate that may be configured to support the elastic member at the lower side of the elastic member.

In some exemplary embodiments, the washing unit may include a pressing member to extract (e.g., squeeze out) a Methyl Ethyl Ketone solution by applying pressure to both sides of the brush at an upper portion of the brush inlet. Additionally, the pressing member may include a first pressing member that may be disposed at one side (e.g., a first side) of the brush and a second pressing member that may be disposed at the opposing side (e.g., other side, a second side) of the brush and may be symmetrical to the first pressing member with respect to the brush inlet. For example, the first pressing member and the second pressing member may reciprocate and apply pressure to the brush. In some exemplary embodiments, the pressing member may include a pair of operating members that reciprocate in a center direction of the brush inlet, a pair of connection portions that may be connected to the pair of operating members and a pair of rollers that may be connected to the connection portion and may be configured to transmit pressure from the pair of operating members into the brush. The pair of rollers may have a cylindrical shape. The pair of rollers may be also be configured to be rotated when a pressure is applied to the brush.

BRIEF DESCRIPTION OF THE DRAWINGS

The above and other features of the present disclosure will be apparent from the following detailed description taken in conjunction with the accompanying drawings.

DETAILED DESCRIPTION

Figure 1:
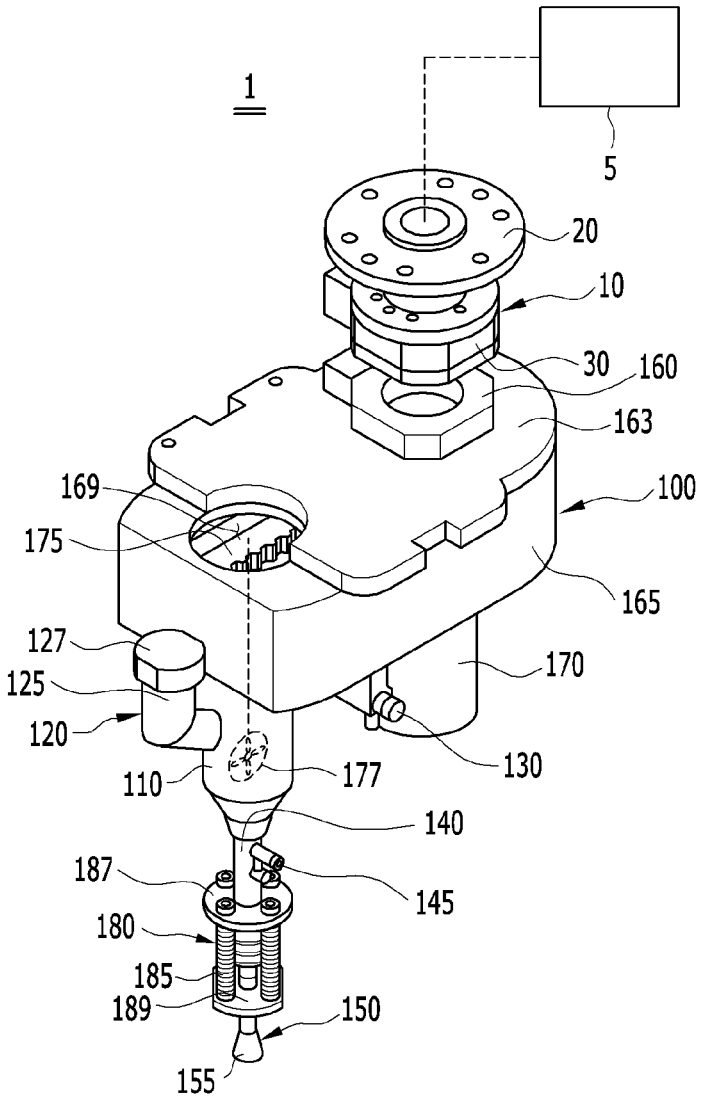
FIG. 1 is an exemplary view showing an application system provided with a primer device according to an exemplary embodiment of the present invention.

Advantages and features of the invention and methods of accomplishing the same may be understood more readily by reference to the following detailed descriptions of exemplary embodiments and the accompanying drawings. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Figure 2:
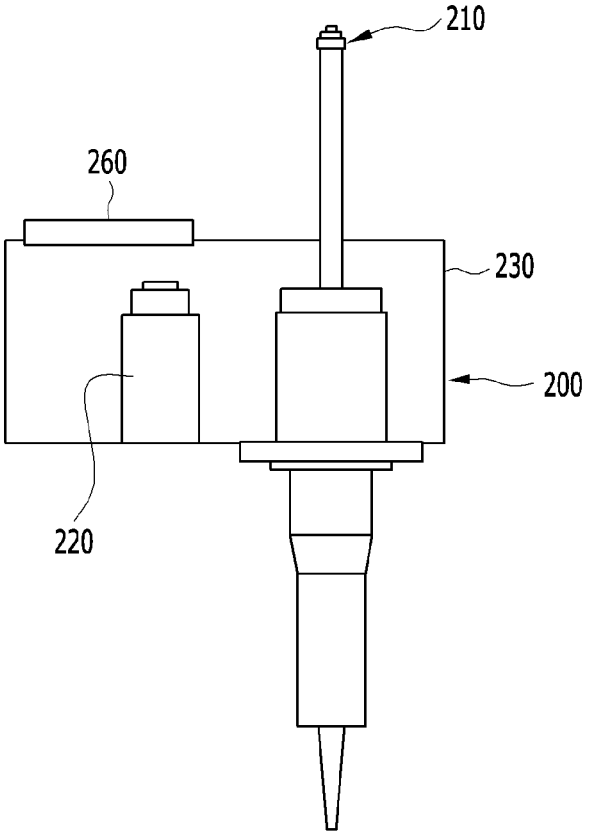
FIG. 2 is an exemplary cross-sectional view of the application system provided with a sealer unit according to the exemplary embodiment of the present invention.

FIG. 1 is an exemplary view illustrating an application system provided with a primer device according to an exemplary embodiment of the present invention. FIG. 2 is an exemplary cross-sectional view of the application system provided with a sealer unit according to the exemplary embodiment of the present invention. Referring to FIGS. 1 to 2, an application system 1 according to an exemplary embodiment may include a robot arm 5, a change tool 10, a primer device 100 that may apply a primer, and a sealer unit 200 that may apply a sealer.

The robot arm 5 may be configured to control a position of the application system 1, and particularly may actuate the application system 1 toward the position to which the primer or the sealer may be applied. The change tool 10 may be mounted at the one end (e.g., a first end) of the robot arm 5, and may be selectively connected to the primer device 100 and the sealer unit 200. Accordingly, application work of the primer and the sealer may be a single process. The change tool 10 may include an adapter 20 and docking interface 30. The adapter 20 may be formed in a disk shape (e.g., alternate geometric shapes) and may be coupled the robot arm 5 via bolts (e.g., screws or alternate coupling devices).

Additionally, the adapter 20 may be configured to reduce vibration when the docking interface 30 and the primer device 100 or the sealer unit 200 are coupled together, and may thereby improve the connectivity of the docking interface 30. The docking interface 30 may be mounted at a lower portion of the adapter 20, and may be selectively coupled (e.g., assembled) to the primer device 100 and the sealer unit 200. The docking interface 30 may be coupled (e.g., combined or attached) to the robot arm 5 by the adapter 20. In particular, by providing docking interface 30 separately, an existing robot arm may be utilized. Further, when the docking interface 30 requires maintenance or repair, the above assembly may allow for improved component exchange and repair.

The primer device 100 may include a primer housing 110, a primer inlet 120, a pressure control valve 130, a nozzle portion 140, and a brush 150. The primer housing 110 may be formed within a hollow cylindrical shape (or the like) and may store the primer therein. The primer inlet 120 may be disposed at the upper side of the primer housing 110 and may be configured to supply the primer into the primer housing 110. For example, the inlet 120 may supply the primer through an inlet pipe 125 formed at the side of the primer housing 110. Additionally, the inlet 120 may further include a cover 127 to prevent foreign substances from flowing therein. The pressure control valve 130 may be configured to adjust the pressure of the interior of the primer housing 110 to supply the primer.

The nozzle portion 140 may provide fluid communication with the primer housing 110, and may be configured to receive the primer from the primer housing 110. The nozzle portion 140 may include a flow control valve 145, and an amount of the primer may be adjusted by the flow control valve 145. The brush 150 may be provided to apply the primer transferred from the nozzle portion 140 to the position where the robot arm 5 introduces the primer to the glass. For example, the brush 150 may be applied to a front glass or a rear glass of a vehicle. The end of the brush 150 may have hairs or other application applying materials 155, and the primer may be applied to an application object such as the front glass or rear glass by the hairs 155.

The primer device 100 may further include an elastic portion 180. The elastic portion 180 may be disposed between the nozzle portion 140 and the brush 150. The elastic portion 180 may include an upper plate 187 that may be connected to the nozzle portion 140, a lower plate 189 that may be connected to the brush 150, and at least one elastic member 185 that may be disposed between the upper plate 187 and the lower plate 189. For example, the at least one elastic member 185 may be disposed in multiple rows. The upper plate 187 or the lower plate 189 may be coupled (e.g., attached) to the elastic member 185 by bolts (e.g., screws or the like). Therefore, the vibration of the primer device 100 may be reduced by the elastic portion 180. Namely, when the primer device 100 applies primer to the object, the elastic portion 180 may prevent an excessive load from being applied to the brush 150.

Moreover, the primer device 100 according to an exemplary embodiment may further include a plate 163, a belt box 165, a motor 170, and an impeller 177. The plate 163 may be connected to the change tool 10 by a connecting portion 160. The connecting portion 160 may be coupled to the sealer unit 200, and may be commonly applicable to the primer device 100 and the sealer unit 200.

The belt box 165 may be disposed at the lower portion of the plate 163, and may include power transmission mechanism such as a gear or a belt disposed therein. For example, a belt 175 may be provided within the belt box 165. Additionally, the plate 163 may be configured to cover the upper portion of the belt box 165. In particular, the plate 163 or the belt box 165 may have a plate aperture 169 to monitor the belt 175 or remaining primer. The motor 170 may be mounted at the belt box 165 and may be configured to transmit torque to the belt 175. The motor 170 may be coaxially disposed within the connecting portion 160, to reduce vibration of the primer device 100. The impeller 177 may be disposed within the primer housing 110 and may be configured to rotate by being connected to the belt 175. Accordingly, it may be possible to prevent the primer disposed within the primer housing 10 from solidifying (e.g., hardening).

Figure 3:
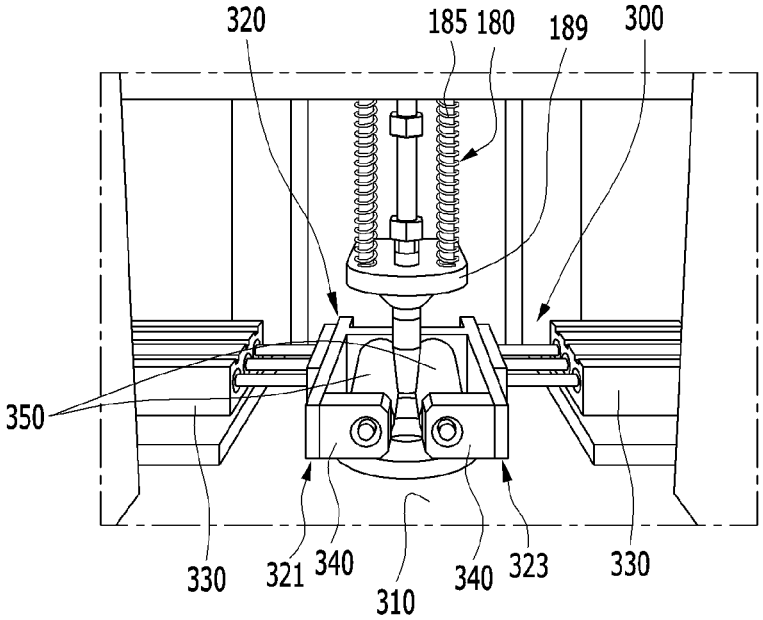
FIG. 3 is an exemplary first perspective view of a washing unit applied to the primer device according to the exemplary embodiment of the present invention.
Figure 4:
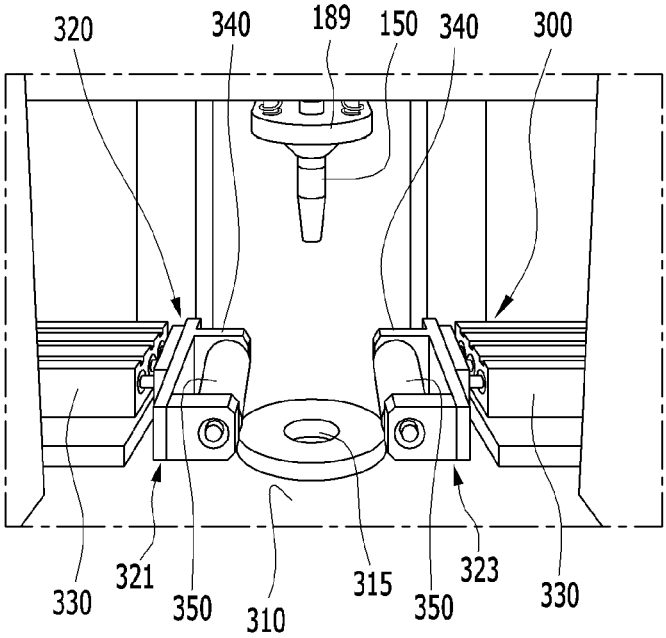
FIG. 4 is a second perspective view of the washing unit applied to the primer device according to the exemplary embodiment of the present invention.

FIG. 3 is an exemplary first perspective view of a washing unit applied to the primer device according to the exemplary embodiment of the present invention. FIG. 4 is an exemplary a second perspective view of the washing unit applied to the primer device according to the exemplary embodiment of the present invention. FIG. 3 illustrates a washing unit 300 in an operational state, while FIG. 4 illustrates a washing unit 300 in a non-operational state.

As shown in FIGS. 3 to 4, the primer device 100 according to an exemplary embodiment may further include a MEK tank 310 that may store a MEK solution. The MEK tank 310 may include a brush inlet 315 to receive the brush 150 therein. The primer device 100 according to an exemplary embodiment may be configured to apply the primer to the application object, and thereafter may receive the brush 150 within the brush inlet 315 of the MEK tank 310 to saturate e.g., soaked) the brush 150 in the MEK solution. In particular, by saturating the brush 150 in the MEK solution, it may be possible to prevent the remaining primer of the brush 150 from solidifying.

The washing unit 300 may be disposed on the MEK tank 310 to extract the liquid from the brush 150. As shown in FIG. 3, the brush 150 may be removed from the MEK tank 310, and the washing unit 300 may provide a pressure to extract the remaining MEK solution from the brush. For example, after the washing unit 300 extracts the MEK solution at the upper side of the brush inlet 315, the MEK solution may be returned into the MEK tank 310. The washing unit 300 may include a pressing member 320 to apply a pressure to the brush 150. The pressing member 320 may include a first pressing member 321 disposed at a first side of the brush 150, and a second pressing member 323 disposed at the second side (e.g., opposite) of the brush 150. The first pressing member 321 and the second pressing member 323 may be symmetrically disposed with respect to the orientation of the brush inlet 315. The first pressing member 321 and the second pressing member 323 may be positioned parallel to one another and may apply pressure to each other. Accordingly, both side of the brush 150 may be subjected to pressure.

Conversely, the pressing member 320 may include a pair of operating members 330 that may be reciprocate in a center direction of the brush inlet 315, a pair of connection portions 340 that may connected to the pair of operating members 330, and a pair of rollers 350 that may be connected to the connection portion 340. The pair of rollers may be configured to apply pressure which may be transmitted from the pair of operating members 330 to the brush 150. The pair of rollers 350 may be formed in a cylinder shape (e.g. or the like) and may be configured to apply pressure on a plurality of sides (e.g., opposing sides) of the brush 150. For example, the pair of rollers 320 may be configured to simultaneously apply a pressure to a plurality of sides of the brush 150 and rotate thereabout the brush. Additionally, the washing unit 300 may be moved upward while the brush 150 is compressed. Since the pair of rollers 320 may be rotated, the hairs 155 may be undamaged, and the MEK solution may be extracted.

Referring to FIG. 2, the sealer unit 200 may include a sealer portion 210 which may be configured to supply the sealer, a motor 220 that may be configured to deliver torque to the sealer portion 210, a sealer housing 230 that may cover the sealer portion 210, and a sealer connecting portion 260 that may be coupled to the sealer housing 230. Hereinafter, a detailed description of the sealer portion 210 will be omitted since the sealer portion 210 is functionally similar to the conventional sealer unit. The sealer connecting portion 260 may be commonly applicable to the connecting portion 160 of the primer device 100. Therefore, the sealer connecting portion 260 may connect to the robot arm 5 directly, and the sealer unit 200 may freely actuate the object by the robot arm 5.

As described above, an exemplary embodiment of the present invention may provide the primer device, and an application system applying the device performing primer and sealer function together. Accordingly, application work of the primer and the sealer may be performed by a single process. Therefore, maintenance and repair costs may be reduced, and the required installation space may be reduced. Moreover, various types of application processes may be performed with improved quality.

While this invention has been described in connection with what is presently considered to be exemplary embodiments, on the contrary, it is intended to cover various modifications and equivalent arrangements included within the spirit and scope of the appended claims. In addition, it is to be considered that all of these modifications and alterations fall within the scope of the present invention.

What is claimed is:

1. A primer device including a brush in order to apply a primer, the primer device comprising:

a Methyl Ethyl Ketone tank configured to store a Methyl Ethyl Ketone solution and having a brush inlet formed on an upper surface thereon to receive the brush therein, wherein the Methyl Ethyl Ketone tank includes a washing unit configured to apply pressure to both sides of the brush such that remaining Methyl Ethyl Ketone solution is returned therein, wherein the washing unit includes a pressing member to extract the Methyl Ethyl Ketone solution by applying pressure to opposing sides of the brush at an upper side of the brush inlet, wherein the pressing member includes:

a pair of operating members that reciprocate in a center direction of the brush inlet;

a pair of connection portions connected to the pair of operating members; and a pair of rollers connected to the connection portion and configured to transmit pressure from the pair of operating members into the brush, wherein each of the pair of rollers is formed in a cylindrical shape, and wherein the pair of rollers are configured to be rotated in a direction perpendicular to a direction in which the pair of operating members reciprocate when the brush is compressed.

2. The primer device of claim 1, wherein the pressing member includes:

a first pressing member disposed at a first side of the brush; and a second pressing member disposed at a second side of the brush and is symmetrical to the first pressing member with respect to the brush inlet, wherein the first pressing member and the second pressing member reciprocate and compress the brush.

* * * * *